US006031972A

United States Patent [19]

Barker

[11] Patent Number: 6,031,972

[45] Date of Patent: Feb. 29, 2000

[54] IMPEDANCE HEATING SYSTEM

[75] Inventor: Carl E. Barker, St. Louis County, Mo.

[73] Assignee: Industrial Engineering & Equipment Company, St. Louis, Mo.

[21] Appl. No.: 09/008,669

[22] Filed: Jan. 19, 1998

[51] Int. Cl.[7] ..... F24H 1/10

[52] U.S. Cl. ..... 392/478; 392/479; 138/33

[58] Field of Search ..... 392/478, 479, 392/480, 486; 138/33, 114, 112, 113

[56] References Cited

U.S. PATENT DOCUMENTS

| | | | |
|---|---|---|---|
| 3,617,699 | 11/1971 | Othmer | 392/469 |
| 3,975,617 | 8/1976 | Othmer | 392/469 |
| 4,408,117 | 10/1983 | Yurkanin | 392/441 |
| 4,804,158 | 2/1989 | Collins et al. | 248/74.4 |
| 4,925,622 | 5/1990 | Gray, III et al. | 376/289 |
| 5,192,039 | 3/1993 | Williams | 248/62 |
| 5,256,844 | 10/1993 | Grosvik et al. | 392/478 |
| 5,771,941 | 6/1998 | Almeida | 138/149 |

*Primary Examiner*—Teresa Walberg
*Assistant Examiner*—Vinod D Patel
*Attorney, Agent, or Firm*—Polster, Lieder, Woodruff & Lucchesi, LC

[57] ABSTRACT

An impedance heating system generally includes an outer tubular member having a first end and a second end, and an inner tubular member having a first end and a second end positioned coaxially inside the outer member. The inner member extends substantially the entire length of the outer member such that the first and second ends of the inner member terminate in close proximity to the first and second ends of the outer member, respectively. A power source is electrically connected to the first end of the inner member for supplying current to the inner member upon energization of the impedance heating system. A return path for current flow from the inner member to the power source generally includes either the outer member or a return cable electrically connected to the inner member. One or more spacer members are secured around the circumference of the inner member at spaced-apart intervals. Each spacer member includes a plurality of radially outwardly extending flanges for coaxially positioning the inner member within the outer member. The flanges are adapted to allow for the inner member and the spacer members to be slidably received within the outer member. Dielectric insulation is disposed between the inner member and each spacer member to electrically isolate the spacer members from the inner member.

13 Claims, 4 Drawing Sheets

IMPEDANCE HEATING SYSTEM

BACKGROUND OF THE INVENTION

This invention generally relates to electric heating systems, and in particular to an impedance heating system that can be used in a wide range of applications to heat materials such as gases or fluids that are flowing through pipelines or contained in storage tanks. For example, the impedance heating system can be used to heat the contents of a rail car storage tank, or a pipeline assembly associated with a storage and distribution system having several miles of pipeline.

As is known in the art, the object to be heated in an impedance heating system generates heat as a result of an alternating current (AC) passing through it. In a pipeline impedance heating system, the walls of the pipe act as an electric heating element when AC voltage is applied to the pipeline. Impedance heating systems can be used to prevent freezing in cold weather, to maintain fluidity of substances that are viscous or solid at ambient temperature, to heat temperature sensitive materials, and to heat fluids and gases to a desired temperature. Substances heated by such a system can include, for example, asphalt, chocolate, chemicals, creams, crude oils, cooking oils, fuel, formaldehyde, gases, high pressure air, ink, lubricants, molasses, molten magnesium, paint, paraffin, propane gas, soaps, sulfur, synthetic resins, syrups, tars, wax and water.

In a typical configuration, a low voltage current (e.g., 80 V or less) is applied from a transformer associated with a power supply to one end of an electrically conductive pipe. Current flows through the pipe to the other remote end, and then back to the transformer via a return path. In pipeline storage and distribution assemblies, the return path typically includes an insulated electrical return cable disposed parallel to the pipeline. In storage vessel applications, the return path includes an outer conductive member (such as an outer pipe) in which the inner member is disposed. In this configuration, the outer pipe typically is electrically connected to the inner pipe at the remote end.

Impedance heating systems are capable of producing substantial heat within a storage tank or pipeline. Resistance ($I^2R$) heating develops when current flows in the pipe. The effective resistance of the pipe varies based upon pipe length, composition and wall thickness. If the material transported by the pipe is electrically conductive, the resistive load further increases. The rapid changes of a 60 Hz alternating current induce an electromotive force and self inductance that opposes current flow (reactance). The reactance combines with the resistance to further impede current flow and generate heat. Magnetic flux coupling between current paths in the impedance heating system also produces heat due to hysteresis (molecular friction) and eddy currents.

Use of impedance heating systems in rail car applications often have significant drawbacks. During switching, coupling and uncoupling of the rail cars, the impedance heating system is subjected to a tremendous shock loads. The impedance heaters experience further vibrational forces during rail transport. Impedance heaters often break down when exposed to these loads, resulting in failure of the heating system. Electrical or dielectric insulation typically is positioned between the inner pipe and the outer pipe to electrically isolate the pipes. Gaps often exist between the inner pipe and the dielectric insulating material because of the nature of the materials commonly used, and/or how the materials commonly are attached. Gaps also are necessary to allow for differences in the rates of thermal expansion between the inner pipe and the dielectric insulator. When loads accelerate across these gaps, coming to an abrupt stop at the other side of the gap, a significant hammering action results which often is sufficient to break or shatter a rigid insulating material such as ceramic. Therefore, it is desirable to develop a support structure for an impedance heating system that is able to withstand the forces associated with rail car transportation, and prevents insulation failure while allowing for thermal expansion of the system. It is further desirable to use an insulating material with high compression capabilities that will not break when subjected to high forces.

Drawbacks associated with impedance heating systems used for pipeline storage and distribution systems include thermal insulation failure and accidental grounding of the system. The pipeline impedance heating system typically includes a thick layer of rigid insulation such as calcium silicate that is wrapped around the inner pipe to thermally insulate the pipe and prevent heat loss. An outer jacket, often constructed from a material such as aluminum sheet metal, is then wrapped around the insulation to protect the insulation from the environment. These thermally insulated pipelines can be up to twelve inches in diameter and several hundred feet in length, with bends, turns, rises and drops, all of which require substantial structural support. The structural support must be capable of safely supporting the insulated pipeline from expansion and seismic loads imposed from various directions. Since an electrical potential is imposed on the pipeline, the supports must be capable of not only structural support, but also of maintaining dielectric isolation of the pipeline from ground. The outer jacket material of pipeline impedance heating systems degrades over time as the assembly shifts or moves as a result of thermal expansion and contraction of the pipeline, pumping loads and vibrations such as earthquakes. If the integrity of the outerjacket is compromised (e.g., torn or punctured), the thermal insulation may become damp or damaged when exposed to certain environmental conditions, thereby resulting in loss of the dielectric properties as well as the thermal insulating properties of the material, further resulting in the grounding out of the system and system failure. The insulation also may be damaged upon assembly of the system. Therefore, it is desirable to provide a support structure for pipeline systems that will not cause system failure should the outer jacket or thick insulation wrapped around the inner pipe become damaged.

Such a pipeline assembly typically is supported by a foot connected to the inner pipe and sitting on a structural base with a dielectric insulating material between the base of the foot and the structural base (electrical ground). The dielectric insulating material may degrade over time because of environmental and structural load conditions, and thus "short-out" the system. In this configuration, the heating system can be short circuited when the insulation or support foot degrades over time or because of environmental conditions. When a short occurs in the impedance heating system, it can be difficult to locate the problem area (e.g., between the support foot and ground, or between a jacket bracket and the support foot). Often, the system must be disassembled and all the insulation must be removed from the inner pipe to find the source of the problem. Therefore, it is desirable that the support structure used to protect and insulate the inner pipe be adaptable to provide the necessary support for a pipeline system that will not pose a risk of short circuiting the system when used for an extended period of time or in harsh environmental conditions.

BRIEF SUMMARY OF THE INVENTION

Accordingly, one object of the present invention is to provide a new and improved impedance heating system having an inner pipe disposed inside an outer pipe or jacket that includes a dielectric insulating material wrapped around the inner pipe at predetermined intervals and a support structure clamped around the dielectric insulating material and inner pipe to coaxially support the inner pipe within the outer pipe or jacket and electrically isolate the inner pipe from the outer pipe or jacket.

Another object of this invention is to provide an improved impedance heating system wherein the dielectric insulating material wrapped around the inner pipe has high compression characteristics.

Another object of this invention is to provide an improved impedance heating system that is able to withstand vibrational loads associated with rail car transportation and shock loads associated with rail car switching, coupling and uncoupling.

Still another object of this invention is to provide an improved impedance heating system wherein the dimensions of the support structure allow the inner pipe to slide easily within the outer pipe when the support structure is attached thereto, and allow for thermal expansion of the inner pipe upon energization of the system.

Another object of this invention is to provide an improved impedance heating system that maintains thermal and electrical properties of the system at operating temperatures of at least 700° F. on the inner pipe and approximately 500° F. or less on the outer pipe in a rail car storage tank assembly.

Another object of this invention is to provide an improved impedance heating system for a pipeline storage and distribution systems that can withstand severe structural and environmental conditions, and provide continuous operation over an extended period of time without deterioration and with little or no maintenance.

Another object of this invention is to provide an improved impedance heating system that protects against system failure should the outer jacket of a pipeline assembly become damaged.

Yet another object of this invention is to provide an improved impedance heating system wherein a modified support structure is secured to the outerjacket in a pipeline assembly to support the pipeline assembly and protect against short circuiting of the system.

These and other objects and advantages will become apparent to those skilled in the art in light of the following disclosure and accompanying drawings.

In accordance with the invention, generally stated, an impedance heating system is disclosed that includes an outer tubular member having a first end and a second end, and an inner tubular member having a first end and a second end positioned coaxially inside the outer member. The inner member extends substantially the entire length of the outer member such that the first and second ends of the inner member terminate in close proximity to the first and second ends of the outer member, respectively. The system further includes a power source electrically connected to the first end of the inner member for supplying current to the inner member to energize the impedance heating system. Upon energization of the system, current flows from the first end to the second end of the inner member. A return means also is provided that is electrically connected between the second end of the inner member and the power source to allow for current flow therethrough upon energization of the impedance heating system. One or more spacer members are secured around the circumference of the inner member at spaced-apart intervals. The spacer members includes a plurality of flanges extending radially outwardly for coaxially positioning the inner member within the outer member. The inner member and spacer members are adapted to be slidably received within the outer member. The impedance heating system further includes dielectric insulation having high compression characteristics that is disposed between the inner member and each spacer member to electrically isolate the spacer members from the inner member.

In the preferred embodiment, each spacer member includes two segments having a substantially semicircular arc shape adapted to fit snugly around the dielectric insulation upon assembly of the spacer member. Three flanges extend radially outwardly from each segment, with one flange being disposed at each end of the segment and the remaining flange being positioned equidistant from the other two flanges. The flanges located at the ends of the one segment are secured to corresponding flanges located at the ends of the other segment upon assembly of the spacer.

Another aspect of the present invention is an impedance heating system for heating material contained inside a storage tank. The impedance heating system includes a tubular outer conductor having a first end extending inwardly into said tank such that the outer conductor is immersed in the material contained in the tank, and a second end mounted to an opening formed in the tank. Means is provided for supporting the outer conductor inside the tank. The system also includes a conductive end cap secured to and sealing the first end of the outer conductor. A tubular inner conductor is positioned coaxially inside the outer conductor. The inner conductor has a first end which is secured to the conductive end cap, whereby the first ends of the inner and outer conductors are maintained in electrical communication by the end cap, and a second end which terminates in close proximity to the second end of the outer conductor. A power source is provided to energize the system. The power source has a positive terminal electrically connected to the first end of the inner conductor for supplying current to the inner conductor upon energization of the impedance heating system, and a negative terminal electrically connected to the first end of the outer conductor, whereby the inner and outer conductors and end cap define an electrical current path allowing for current flow therethrough upon energization of the impedance heating system. The system also includes a plurality of dielectric insulators having high compression characteristics, whereby two layers of dielectric insulation are wrapped around the inner conductor at predetermined spaced-apart intervals. A plurality of spacers are further included, with each spacer having a cylindrical body secured around the dielectric insulation and a plurality of flanges extending radially outwardly from the body for coaxially positioning the inner conductor within the outer conductor. The dielectric insulation electrically isolates the spacers from the inner conductor.

Yet another aspect of the present invention is that of an impedance heating system for heating material contained inside a pipeline storage and distribution system. The impedance heating system includes an inner pipe for containing the material, and an outer cylindrical member for housing the inner pipe therein. Means is provided for electrically isolating the outer member from the inner pipe, and coaxially supporting the inner pipe within the outer member. A power source is electrically connected to the inner pipe via a power cable for supplying current to the inner member upon energization of the impedance heating system. The system also includes a return cable which has one end electrically connected to the inner pipe at a remote location with respect to the power cable, and a second end connected to the power source. The power cable, inner pipe and return cable define an electrical path for current supplied by the power source upon energization of the impedance heating system. One or more pairs of outer dielectric insulation layers are wrapped around the outer member at predetermined spaced-apart intervals. One or more clamps having a cylindrical tubular body portion are positioned around each pair of outer dielectric insulation layers. The insulation layers are secured in position between the clamps and the outer member. The preferred embodiment of the impedance heating system further includes a support structure secured to each outer clamp to provide support for the pipeline system.

Other objects and features will be apparent and in part pointed out hereinafter.

BRIEF DESCRIPTION OF THE SEVERAL VIEWS OF THE DRAWING

The objects of the invention are achieved as set forth in the illustrative embodiments shown in the drawings which form a part of the specification.

Corresponding reference characters indicate corresponding parts throughout the several views of the drawings.

DETAILED DESCRIPTION OF THE INVENTION

Figure 1:
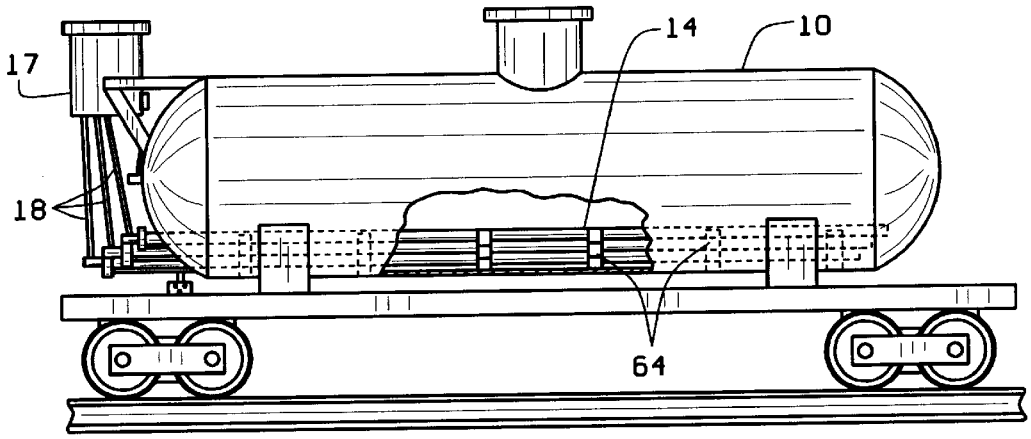
FIG. 1 PRIOR ART
FIG. 1 is a side view of a rail car storage tank, having a portion of the tank wall removed to show one illustrative embodiment of an impedance heating system of the present invention.
Figure 4:
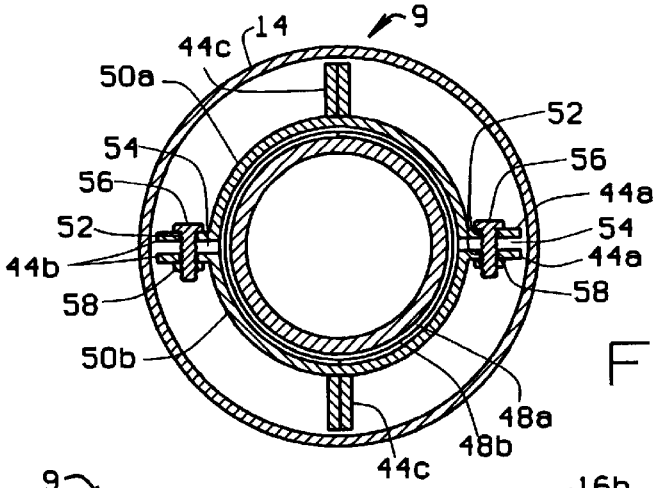
FIG. 4 is a cross sectional view of the impedance heating system shown in FIG. 3, taken along line 4—4.
Figure 6:
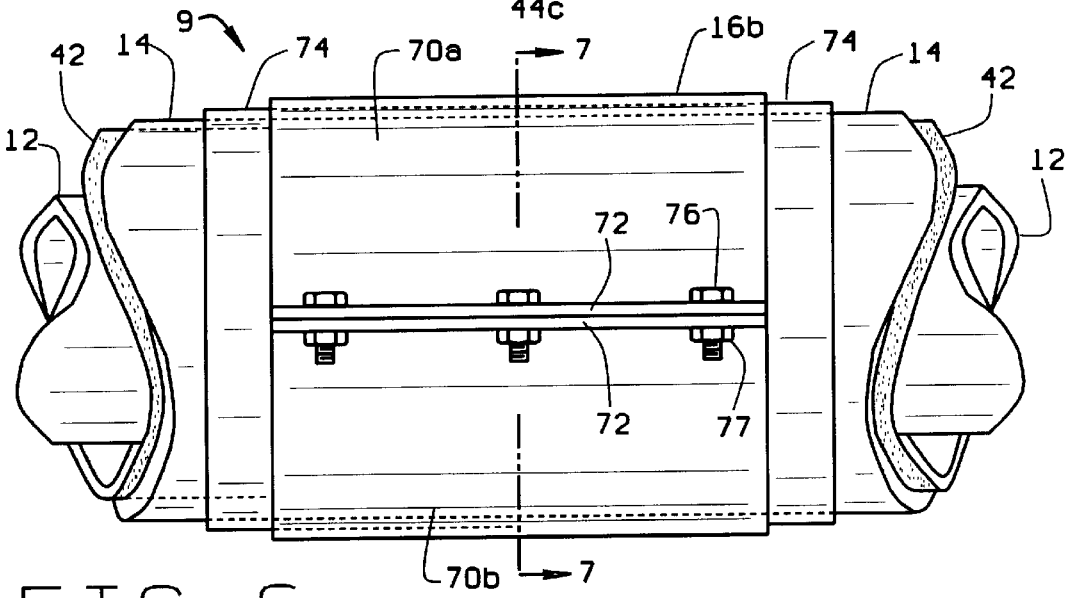
FIG. 6 is a fragmentary sectional side view of the pipeline impedance heating system shown in FIG. 5, showing an outer spacer member secured around dielectric insulation that is wrapped around the outer jacket of the pipeline assembly.
Figure 5:
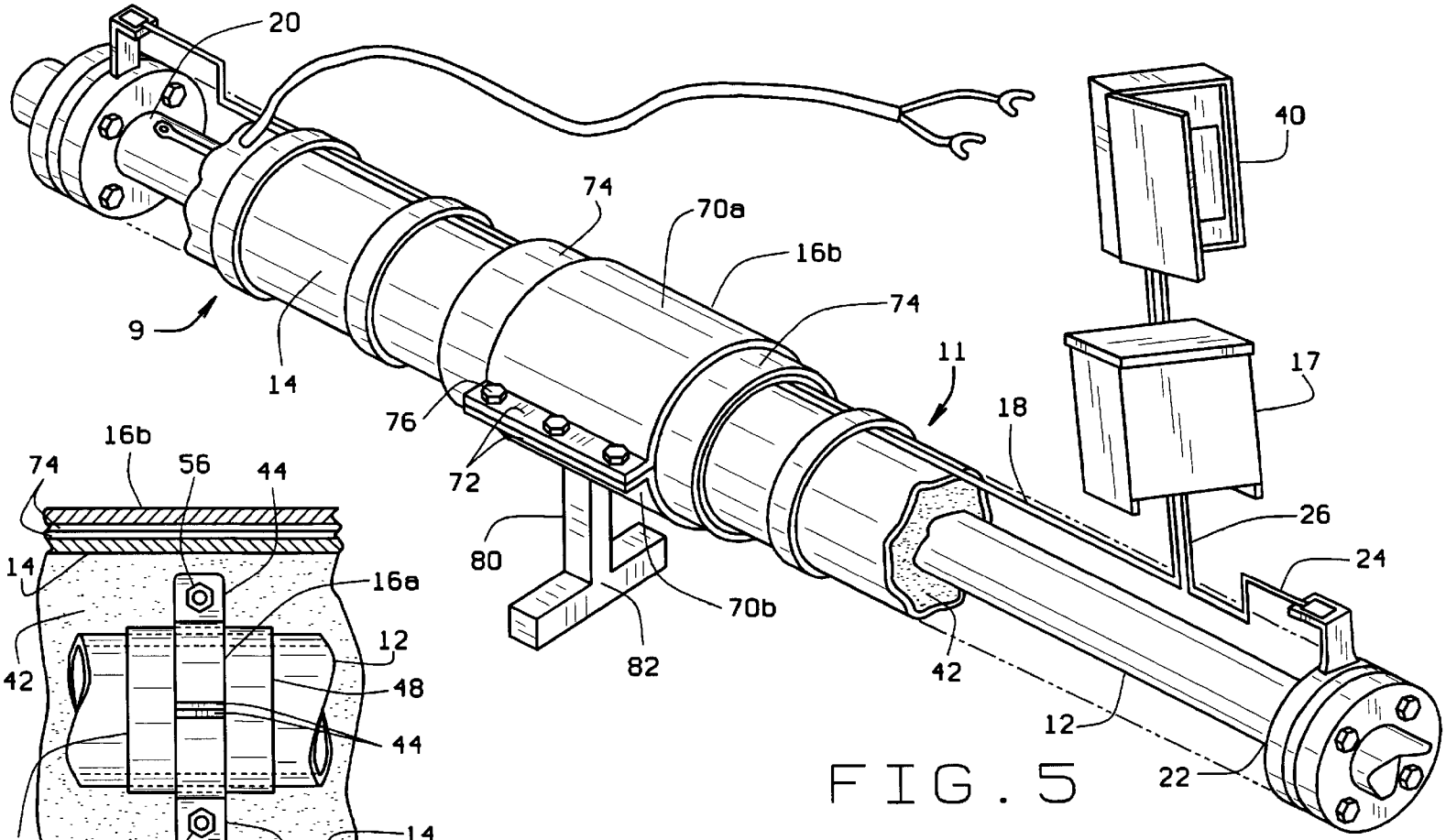
FIG. 5 is an isometric view of a second illustrative embodiment of the impedance heating system of the present invention used to heat material flowing through a pipeline assembly, showing an outer spacer securely mounted on the outer member.

Referring now to FIGS. 1 and 5, there are shown two embodiments of impedance heating systems, indicated generally at 9. As is known in the art, impedance heating systems 9 can be used in a variety of applications, e.g., for heating material stored in a tank or vessel such as a rail car storage tank 10 (FIG. 1), or for heating material flowing through a pipeline assembly 11 (FIG. 5). The impedance heating system 9 generally includes an inner member 12 having a substantially hollow cylindrical shape such as a tube or pipe. The inner member 12 is disposed inside an outer member 14 having a substantially tubular or cylindrical shape such as a pipe or metal jacket (FIGS. 2–5 and 7–9). The inner and outer members 12, 14 have substantially similar axial length when the impedance heating system 9 is deenergized. As will be discussed in greater detail below, the inner member 12 acts as a heating element upon energization of the impedance heating system 9 to heat material flowing through or maintained in thermal communication with the inner member 12. The composition, diameter, thickness and length of the inner and outer members vary depending on particular requirements associated with each application.

As discussed in greater detail below, the present invention relates to a novel inner spacer structure 16*a* used in impedance heating systems to coaxially support and electrically isolate the inner member 12 with respect to the outer member 14. This invention also provides a novel outer clamp structure 16*b* that is secured around the outer member 14 when used in pipeline applications (FIGS. 6–9). Since construction and operation of impedance heating systems are well know in the art, the construction and operation of the impedance heating system 9 are set forth generally herein, as they relate to the present invention. It will be appreciated by those skilled in the art that the present invention can be used in any impedance heating system 9, including those used to heat storage tanks 10 and pipelines 11. As discussed below, the inner spacer structure 16*a* is designed to allow for slidable movement of the inner pipe 12 within the outer member 14. This design allows the system to be easily assembled, and to accommodate differing rates of thermal expansion for the inner and outer members 12, 14 upon energization of the system 9.

Figure 2:
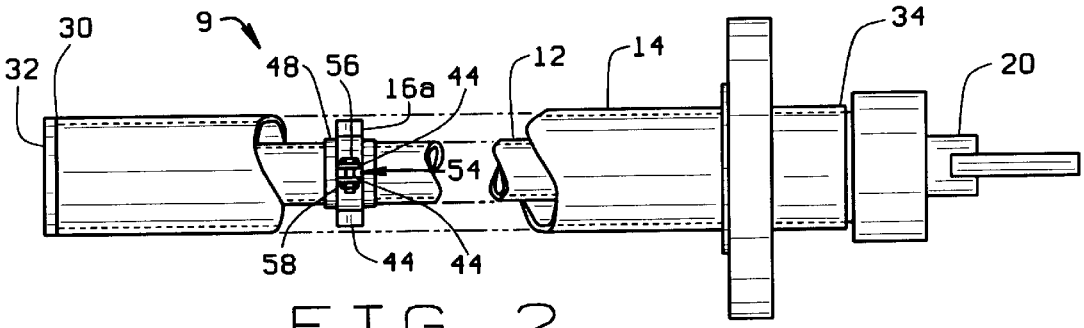
FIG. 2 is a side elevational view of the impedance heating system shown in FIG. 1, having a portion of an outer pipe removed to illustrate a novel inner spacer of the present invention secured to an inner pipe.
Figure 3:
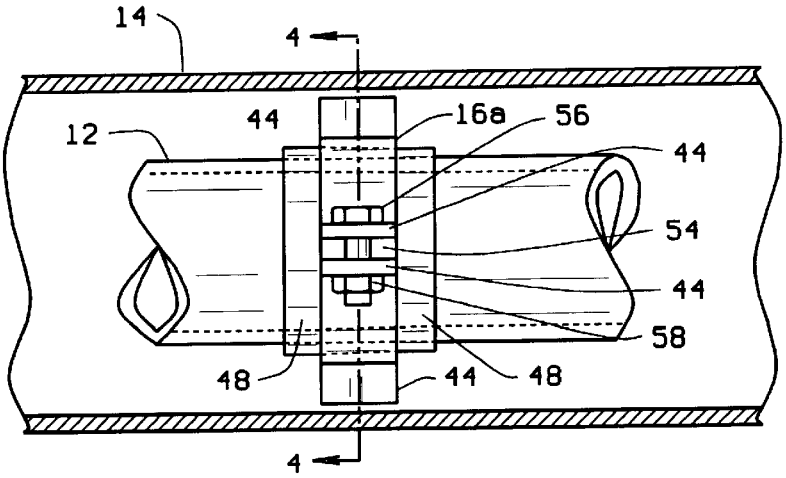
FIG. 3 is a fragmentary sectional side view of the first embodiment of the present invention, having a portion of the outer pipe removed to illustrate the positioning of the inner spacer and pipe within the outer pipe.

As shown in FIGS. 1 and 5, the impedance heating system 9 also includes a power supply 17 such as a power transformer that preferably supplies a low voltage at a high current to the inner member via a power cable 18. Output voltages generated by the power supply 17 preferably are within the range of 1 to 80V, depending upon the application. The power cable 18 is electrically connected between a positive terminal of the power source 17 and a first end 20 of the inner pipe 12. Current flows through the inner member 12 to a remote second end 22 of the inner member 12 as shown in FIGS. 2 and 5, and then through a return path 24 extending from the second end 22 of the inner member 12 to a negative terminal of the power source 17.

As discussed below in greater detail, the return path 24 can be a return cable 26 electrically connected to the second end 22 of the inner member 12 (e.g., in a pipeline assembly 11). In this configuration, the return cable 26 preferably is disposed parallel to and in close proximity of the outer member 14 to allow for improved heating of the impedance heating system 9. The cable 26 preferably has an adequate cross section to carry normal currents imposed on the heating system, whether the inner member 12 is empty or full, hot or cold. As will be appreciated by those skilled in the art, an alternative construction of an impedance heating system 9 for a pipeline 11 includes a pipe (not shown) running parallel to the inner member which can be used as the return current path.

When the impedance heating system 9 is used to heat material in a storage tank or vessel such as the rail car tank 10 shown in FIG. 1, the return path 24 preferably includes the outer member 14. In this situation, a remote second end 30 of the outer member 14 positioned inside the tank 10 is maintained in electrical communication with the second end 22 of the inner member 12 also extending inside the tank 28. The second ends 22, 30 preferably are connected electrically via an electrically conductive end cap 32 secured to the second ends 22, 30 of the inner and outer members 12, 14, respectively (see FIG. 2). The end cap 32 also prevents leakage of the stored substance into the impedance heating system 9. Current flows through the outer member 14 in the opposite direction of current flow in the inner member 12. A return cable (not shown) can be connected between a first end 34 of the outer member 14 and the negative terminal of the power source 17 to complete the circuit.

In the pipeline assembly 11 shown in FIGS. 5–9, current flowing through the inner member 12 generates heat due to the resistance of the inner member 12. The resistance of the inner member 12 varies based upon length, composition and wall thickness. Resistance of material transported by the inner member 12 (if such material is electrically conductive) also generates heat. Current flowing through the power and return cables 18, 26 in FIG. 5 or outer pipe 14 in FIG. 2 generates magnetic fields that interact with magnetic fields generated by current flowing through the inner member 12 to produce additional heat. Furthermore, electrical inertia of the inner member 12 to changes in magnetic fields generated by the power source 17 and reluctance of the magnetic flux to reverse polarity produce eddy currents and hysteresis that act as sources of heat in the impedance heating system 9.

In the rail car storage tank assembly (FIG. 1), operating temperatures reach approximately 700° F. on the inner pipe 12 and approximately 500° F. or less on the outer pipe 14. Materials used in the heating system 9 must maintain their electrical, structural and thermal properties at these temperatures.

As known in the art and shown in FIG. 5, the impedance heating system also includes a control unit 40 having control circuitry connected to the power source 17 to selectively energize the impedance heating system 9 based upon the temperature of the inner member 12. A temperature sensing device (not shown) is maintained in thermal communication with the inner member 12 to measure the temperature of the inner member 12, and transmit this temperature information to the control circuitry. The control circuitry then energizes or deenergizes the system 9 by selectively activating the power source 17 based upon the measured temperature. When the measured temperature falls below a desired level, the control panel 40 activates the power source 17 to energize the inner member 12. Likewise, when the measured temperature reaches the desired level, the control circuitry deenergizes the power source 17 and impedance heating system 9. The control circuitry used in a pipeline assembly also provides ground fault protection for the impedance heating system by cutting off power from the power source when a ground condition is detected.

As discussed above, the preferred embodiment of the present invention includes a plurality of inner spacer members 16*a* that coaxially position and support the inner member 12 inside the outer member 14 (FIGS. 2–4, 7–9). The inner spacers 16*a* also are used to electrically isolate the inner member 12 from the outer member 14 (except at desired connecting points). As will be discussed in greater detail below, the inner spacers 16*a* preferably are employed in the pipeline impedance heating system (FIGS. 5–9), but are not required when rigid inner insulation 42 is used that provides sufficient support of the inner member 12 in a coaxial manner inside the outer member 14. The inner spacers 16*a* are positioned at predetermined intervals along the inner member 12. The spacers 16*a* clamp around the inner member 12 to provide 360° capture and support of the inner member 12.

As discussed below in greater detail, each spacer 16*a* includes a plurality of radially outwardly extending flanges 44 that assist in positioning the inner member 12 inside the outer member 14 (see FIGS. 3, 4, 7–9).

The impedance heating system 9 of the present invention also includes dielectric insulation 48 positioned between the inner spacer 16*a* and the inner member 12 to electrically isolate the inner member 12 from the support structure 16*a* and the outer member 14. The width of the insulation 48 is preferably at least one inch greater than the axial width of the spacer 16*a* such that a portion of the insulation 48 extends axially beyond the spacer 16*a* on the inner member 12. The length of the insulation 48 is substantially equal to the outer circumferential length of the inner member 12 such that the insulation 48 surrounds the entire periphery of the inner member 12 with no overlap. In the preferred embodiment, a first layer 48*a* and a second layer 48*b* of insulating material 48 having substantially equal width are employed. The length of the second layer 48*b* is slightly greater than that of the first layer 48*a*. For example, when the inner pipe 12 is two inch pipe (2.375 inches in diameter), such as used in rail car storage tank assemblies (FIGS. 1–4), the first layer 48*a* is approximately 7.46 inches in length, and the second layer 48*b* is approximately 7.65 inches in length such that the first and second layers 48*a*, 48*b* completely encircle in inner pipe 12. The first layer 48*a* is wrapped around the periphery of the inner member 12, and then the second layer 48*b* is wrapped around the first layer 48*a* such that the second layer 48*b* covers facing ends of the first layer 48*a* as shown in FIGS. 4, 7, and 8A–C, thereby providing sufficient offset (preferably 180°) to protect against flux leakage from the inner member.

The type and thickness of insulation 48 varies, depending upon the application for which the impedance heating system 9 is employed and temperatures to which the system 9 is subjected. The insulation 48 preferably has high compression characteristics, a compact, homogeneous and rigid construction, and no gaps allowing for flux leakage at interfaces with the inner member and spacer. For example, when the impedance heating system 9 is employed for heating materials in a rail car storage tank 10, the dielectric insulation 48 can include two layers of two (2) inch wide general purpose, non-asbestos gasket sheet material such as NON-ABS #1, sold by Sealcraft, for the dielectric barrier. Other thermal insulation materials suitable for particular applications include, for example, a compressed ceramic material such as the material sold under the trademarked name LYTHERM which is suitable for temperatures above 500° F. For low temperature applications (e.g., less than 200° F., a silicone rubber material such as a type conforming to ASTMD 1330 can be used. A Teflon material can be use for temperatures ranging from 200° F. to 350°.

In the preferred embodiment, the inner spacer 16*a* includes two segments 50*a*, 50*b* (referred to generally as segment 50) having a substantially 180° arc shape as shown in FIGS. 4, 7 and 8A–8C. The segments 50 have inner radii of curvature substantially equal to the outer radius of the inner member 12 plus the radial thickness of the dielectric insulation 48, such that each segment fits snugly on the insulation 48 upon assembly of the impedance heating system. The arc length of each segment 50 is slightly less than half of the circumferential length of the second layer of insulation 48*b*. Each segment 50 has a plurality of radially outwardly extending flanges 44 welded to its outer surface as shown in FIGS. 2–4 and 7–8C. The flanges 44 have an axial width approximately equal to the axial width of the segment 50. The radial height of each flange 44 is slightly less than the difference between the inner radius of the outer member 14 and the outer radius of the arc-shaped segment 50.

In the preferred embodiment, three flanges are included on each segment, namely a first flange 44*a* and second flange 44*b*, disposed at each end of the segment 50, and a third flange 44*c* disposed at a location along the segment equidistant between the first and second flanges 44*a*, 44*b*. Flanges 44*a* and 44*b* have an opening 52 formed therethrough as shown in FIG. 4. Upon assembly of the impedance heating system, the two layers of insulating material 48*a*, 48*b* are wrapped around the inner member 12 at the desired location of the inner spacer member 16*a*. The two segments 50 of the spacer 16*a* are positioned on the dielectric insulation 48 as shown in FIG. 4 such that the openings 52 associated with the first and second flanges 44*a*, 44*b* of one segment (e.g., segment 50*a*) are aligned with the openings 52 in the first and second flanges 44*a*, 44*b* of the other segment (e.g., segment 50*b*). As discussed above, the peripheral length of each segment 50 is slightly less than half of the outer circumferential length of the dielectric insulation 48, resulting in a gap or space 54 between facing end flanges 44*a*, 44*b*. A bolt 56 is inserted through each pair of aligned flange openings 52, and a nut 58 is screwed onto each bolt 56 as shown in FIGS. 4,7 and 8A–C. The gap 54 is provided to allow for slight radially outward movement of the inner spacer 16*a* upon radial thermal expansion of the inner member 12 during energization of the impedance heating system 9. This design allows the support structure 16*a* to remain in snug engagement with the inner insulation 48 and the pipe 12 during thermal expansion, preventing any gaps between the insulation 48 and the inner pipe 12.

Once installed, the inner spacers 16*a* are a rigid, fixed part of the inner member 12. Upon assembly of the impedance heating system 9, a slight clearance exists between the flanges 44 and the inner surface of the outer member 14 such that the inner member 12 and spacers 16*a* are slidably received inside the outer member 14. Corner edges of the flanges 44 preferably are rounded to allow for slidable movement of the spacers 16*a* within the outer member 14. The clearance allows for easy assembly of the impedance heating system 9, and for radial and axial thermal expansion of the inner member 16*a* during energization of the system 9. The flanges 44, dielectric insulation 48 and the inner surface of the outer member 14 can withstand the hammering action that occurs when the impedance heating system 9 is subjected to shock and vibrational loads.

When the impedance heating system 9 is used to heat material stored in a rail car tank 10 (FIGS. 1–4), the rail car tank 10 generally includes an elongated tubular vessel for storage of a substance therein. The tank 10 is shown in FIG. 1 for illustrative purposes only, and it should be understood that any tank or vessel can be used in the present invention. The structure and components of a rail car 10 are well known in the art, and are shown and discussed generally herein. The outer members 14 of the rail car 10 impedance heating system 9 include a plurality of cylindrical pipes 14 extending inwardly into the tank 10 in the vicinity of a lower portion of the tank 10 (FIG. 1). The outer pipes 14 are mounted to a tank wall at spaced apart intervals as generally shown in FIG. 1. A plurality of supports 64 are disposed between the outer pipe 14 and the tank wall to support the impedance heating system 9 within the tank 10.

The rail car storage tank 10 impedance heating system 9 also includes the inner conduction member 12 such as a pipe or a rod positioned coaxially inside the outer pipe 14 by the inner spacers 16 (FIG. 2). In a typical configuration, the length of a rail car tank 10 is approximately forty (40) feet. The inner and outer members 12, 14 extend approximately the entire length of the rail car tank 10, allowing for axial thermal expansion of the inner and outer members, upon energization. In general, the inner and outer members 12, 14 typically expand approximately 1.5 inches axially upon energization of the impedance heating system 9. Radial thermal expansion is minimal (e.g., less than 0.015 inches). In the preferred embodiment of the rail car tank assembly 10, the inner member 12 preferably is a two (2) inch schedule 160 steel pipe, having a nominal weight of 7.46 lbs. per foot, and a nominal length of 40 feet. The outer member preferably is a four (4) inch Schedule 40 pipe, having a nominal length of 40 feet.

The two layers of dielectric insulation 48*a*, 48*b* are wrapped around the inner conduction member 12 at predetermined intervals (e.g., every three feet). In the preferred embodiment for rail car tank 10 applications, NON-ABS #1 or a similar synthetic fiber compressed sheet is used for the insulation because of its high compression characteristics toughness, flexibility and good dielectric properties. The two segments 50 of the inner spacers 16*a* then are clamped around the inner conduction member 12 and insulation 48 as discussed above. As further discussed above, the rail car storage tank 10 impedance heating system 9 also includes the end cap 32 that is welded to the inwardly extending ends 22, 30 of the inner and outer members 12, 14 positioned inside the tank to electrically connect the inner conductor 12 to the outer pipe 14. The outer pipe 14 functions as a return current path, as discussed above. The end cap 32 also prevents seepage of the substance stored in the tank into the impedance heating system.

In this configuration, the inner spacers 16*a* maintain the inner pipe 12 in a substantially centered position within the outer pipe 14 at all times, and electrically isolate the inner pipe 12 from the outer pipe 14 (except at the point of connection via the end cap 32). The dimensions of the inner spacers 16*a* also allow the inner conductor 12 to slide easily inside the outer member 14 upon assembly and during thermal expansion of the inner and outer members 12, 14. The material from which the spacers 16*a* are constructed maintains its thermal and electrical properties at operating temperatures of approximately 700° F. on the inner pipe 12 and 500° F. or less on the outer pipe 14. Preferably, the spacers 16*a* are constructed from 1010 carbon steel. The inner spacers 12 have a rugged construction that is capable of withstanding vibration loads associated with rail transport and shock loads associated with rail car switching, coupling and uncoupling. Moreover, the impedance heating system is designed to withstand severe environmental conditions without deterioration.

As shown in FIGS. 5–9, when the impedance heating system 9 is used to heat material flowing through a pipeline 11 (e.g., in refinery applications), the inner member 12 is a standard pipeline, such as SA-54 Gr. B., typically having a diameter of 4 to 12 inches. The outer member 14 preferably is an insulation jacket, such as an aluminum sheet metal jacket. As mentioned above, thermal insulation 42 is disposed between the inner member 12 and the outer member 14. For example, the insulation can be a spun fiberglass batting type, or a rigid calcium silicate type, or a bulk ceramic fiber type with thickness ranging from one (1) inch to four (4) inches or more, depending upon the process temperature and environmental conditions.

Figure 7:
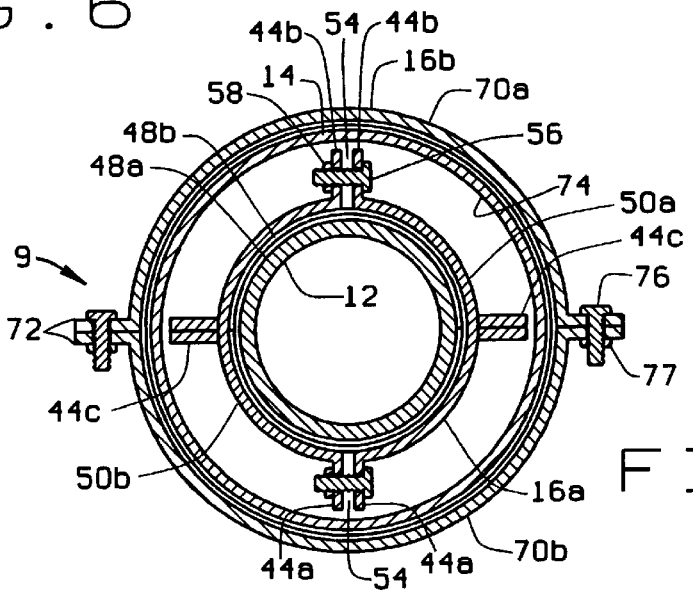
FIG. 7 is a cross-sectional view of the impedance heating system shown in FIG. 6, taken along line 7—7.
Figure 9:
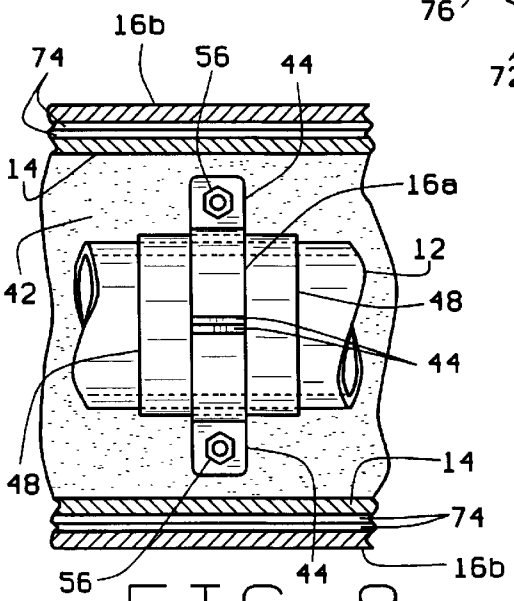
FIG. 9 is a fragmentary sectional side view of the second embodiment of the pipeline impedance heating system, with a portion of the outer clamp, outer insulation and outer jacket removed to show the inner spacer member and inner pipe positioned inside the outer jacket.

When rigid insulation 42 is employed between the inner and outer members 12, 14, the number of inner spacers 16*a* needed to support the inner member 12 decreases since the insulation 42 provides additional support for the inner member 12. The inner spacers 16*a* also are used to provide support when no rigid insulation 42 is disposed between the inner and outer members 12, 14, or when a rigid insulation jacket 14 is not used, or when a high-strength dielectric support is required between the inner and outer members 12, 14. The spacing of the spacers 16*a* vary based on factors such as, for example, the size and weight of the pipeline, whether the pipeline is suspended or supported. For example, the number of inner spacers 16*a* in a particular application is increased when the inner spacers 16*a* are needed to provide additional support for the inner member 12 within the outer member 14 and electrical isolation of the inner and outer members 12, 14 in the event that the process is critical and possible outages would be catastrophic, or that the installation is either in an inaccessible area or environmental conditions prevent normal maintenance activities. Furthermore, the inner spacers 16*a* protect the integrity of the pipeline 11 impedance heating system 9 if inner rigid insulation 42 is damaged. If the insulation 42 becomes wet, broken, crushed or otherwise compromised, the inner spacers 16*a* provide that inner member 12 remains electrically isolated from the outer member 14 at all times. For each inner spacer 16*a* employed (as shown in FIGS. 7–9), two layers of dielectric insulation 48*a*, 48*b* such as the general purpose gasket sheet, Teflon, or ASTMD 1330 rubber are wrapped around the inner pipe at desired locations for the inner spacers 16*a*. The inner spacers 16*a* then are clamped around the dielectric insulation 48 in the manner discussed above.

Figure 8A:
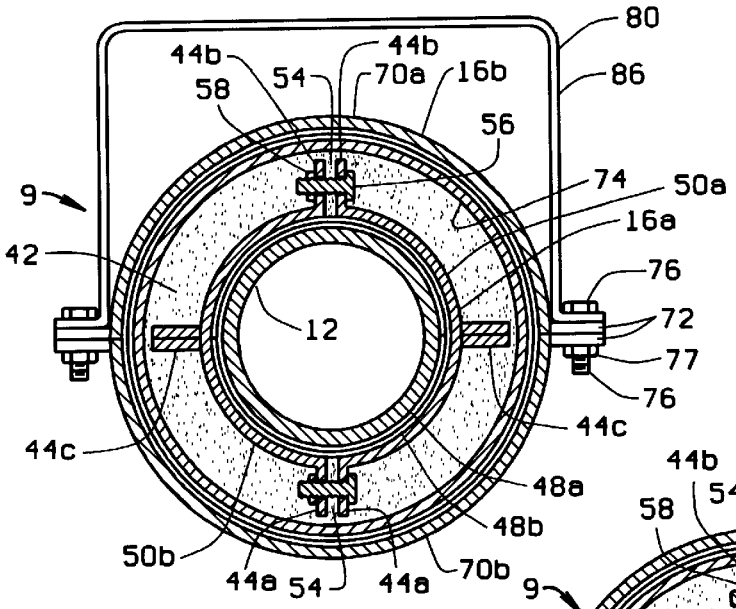
FIG. 8A is a cross-sectional view of the impedance heating system used with a pipeline assembly, showing one embodiment of a support structure secured to the outer spacer member to support the impedance heating system.
Figure 8B:
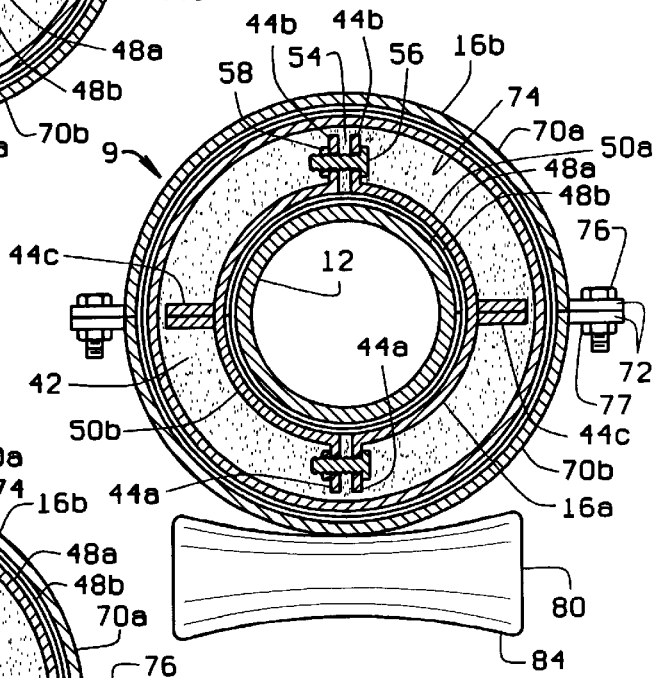
FIG. 8B is a cross-sectional view similar to FIG. 8A of the impedance heating system applied to a pipeline assembly, showing another embodiment of a support structure secured to the outer spacer member to support the impedance heating system.
Figure 8C:
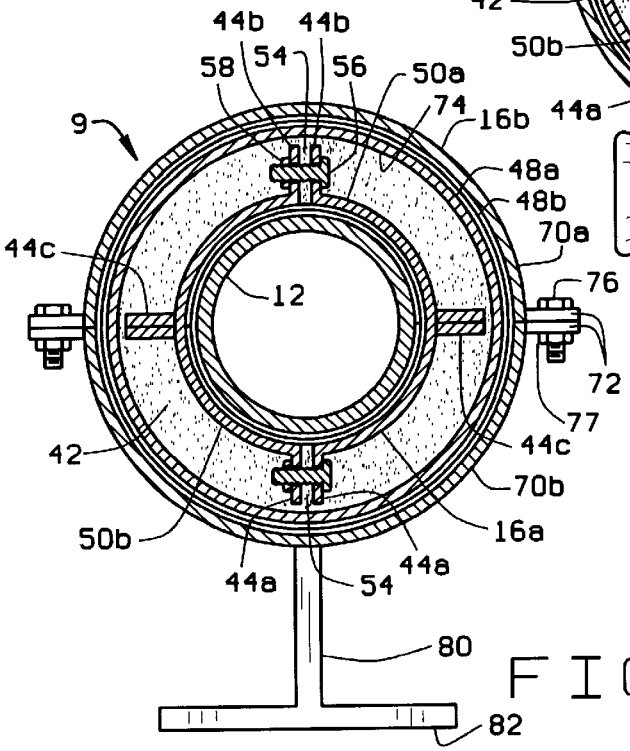
FIG. 8C is a cross-sectional view similar to FIGS. 8A and 8B of the impedance heating system applied to a pipeline assembly, showing still another embodiment of a support structure secured to the outer spacer member to support the impedance heating system.

When the impedance heating system 9 is used to heat material flowing in a pipeline assembly 1, a plurality of outer clamps or collars 16*b* are secured to the outer jacket 14 in a similar manner as discussed above with respect to the inner spacer members 12. Each outer clamp 16*b* includes first and second 180° arc-shaped segments 70 and 70*b* (referred to generally as segments 70) having a plurality of flanges 72 (preferably two) extending radially outwardly therefrom as shown in FIGS. 7–8C. As discussed below and shown in FIGS. 5–9, dielectric insulation 74 is wrapped around the outer member 14, and then the outer clamp 16*b* is secured around the outer insulation layers 74 using bolts 76 and nuts 77. The diameter of the outer clamp 16*b* (the radii of curvature of the segments 70) is based upon the diameter of the outer member 14 plus the thickness of the di-electric insulation 74 (discussed below). In the preferred embodiment, the outer spacer member is constructed from a 12 Ga. or 10 Ga. HRS, hot dipped, galvanized steel. The dimensions of the flanges 72 are such that the axial length of the flange 72 is substantially equal to that of the segments 70, and the radial height varies based upon the particular application and support structure (discussed below) employed. Preferably, the outer clamps 16*b* are spaced approximately every 20 feet along the pipeline assembly.

As mentioned above, two layers of di-electric insulation 74 are positioned between the outer clamp 16*b* and the outer jacket 14 in the preferred embodiment, in a similar fashion as discussed above with respect to the insulation 48 positioned between the inner spacer 16*a* and inner pipe 12. The di-electric insulation 74 extends axially beyond the outer clamp 16*b* to provide a generous oversurface clearance (preferably at least two inches on each side) in the event that the outer member 14 is accidentally grounded. In the preferred embodiment, the outer di-electric insulation 74 is two layers of insulation having high compression characteristics wrapped tightly around the outer pipe member 14. The type of insulation 74 employed in the system 10 is based upon the environmental conditions to which it will be exposed. The temperature of the outer member 14 is less than that of the inner member 12 in impedance heating systems 9 used with a pipeline 11 assembly. For example, Teflon material can be used for temperatures ranging from −40° F. to +600° F., or nonasbestos-1 (NA-1) gasketing material can be used for temperatures up to +700° F., but NA-1 material is subject to degradation in exposed environmental conditions. Each layer 74 has a thickness of approximately 1/16 inch. In this configuration, the inner insulation material 48 used when the inner spacers 16*a* are employed is preferably two layers of ceramic paper sold by Lydall Composite Materials, Hoosick Falls, N.Y. under the trademarked name of LYTHERM, where each layer has a thickness of approximately 1/16 inch. To prevent water penetration, the circumferential joints between the clamps 16*b* and the dielectric insulation 74 and between the dielectric insulation 74 and insulation jacket 14 can be sealed with a room temperature vulcanizing (RTV) flexible rubber sealing compound, or the like.

A support structure 80 is secured to the outer spacer member 16*b* to support the pipeline network 11. The particular type of support structure 80 can vary based upon design requirements and the environment in which the impedance heating system 9 is installed. For example, FIG. 8A shows one embodiment of the support structure 80 wherein a support foot 82 is welded onto each outer spacer member 16*b*. A roller guide 84 as illustrated in FIG. 8B is used in another configuration to support the pipeline 11 impedance heating system 9. Alternatively, a pipe hanger 86 shown in FIG. 8A is used in another embodiment to support the inner and outer members 12, 14.

The outer collar 16*b* and any of the foregoing support structures 80 prevent accidental grounding of the pipeline 11 impedance heating system 9. To achieve uniform heating throughout a circuit of the impedance heating system 9, each heating circuit must be the same electrically from end to end, and isolated from all electrical grounds. The design of the support structures 80 and outer collars 16*b* ensure that pipe expansion does not cause accidental grounding of the circuit. Since some grounding causes stray currents and branch circuits at tees cause division of currents, conventional isolation systems known in the art are installed at tees and equipment connections to prevent any section of the pipeline 11 from being unheated.

The foregoing description is set forth only for illustrative purposes only and is not meant to be limiting. Numerous variations, within the scope of the appended claims will be apparent to those skilled in the art in light of the foregoing description and accompanying drawings.

What is claimed is:

1. In an impedance heating system having an inner cylindrical member positioned inside an outer tubular member, the improvement comprising a plurality of spacer devices adapted to fit securely around the inner member at spaced-apart intervals, each spacer device including a plurality of radially outwardly extending flanges for coaxially supporting the inner member within the outer member, said flanges allowing for slidable movement of the inner member and spacer with respect to the outer member; and insulation wrapped around the inner member and disposed between the inner member and each spacer device for electrically isolating the inner member from the outer member and the spacer device.

2. A support assembly for an impedance heating system having an outer tubular member with an axially extending opening and an inner cylindrical member disposed in the axially extending opening of the outer member, comprising: a plurality of spacer members secured around the inner member at spaced apart intervals, each spacer member including a plurality of radially outwardly extending flanges for coaxially supporting the inner member with respect to the outer member, the flanges being adapted to allow for slidable movement of the inner member and the spacer members with respect to the outer member; and dielectric insulation disposed between the inner member and each spacer member to electrically isolate the spacer members from the inner member.

3. The support assembly of claim 2 wherein each spacer member includes two segments having a substantially semicircular arc shape adapted to fit snugly around the dielectric insulation upon assembly of the spacer member, and three flanges extending radially outwardly from each segment with one flange being disposed at each end of the segment and the remaining flange being positioned equidistant from the other flanges, the flanges located at the ends of the one segment being secured to corresponding flanges located at the ends of the other segment upon assembly of the spacer.

4. The support assembly of claim 3 wherein each arc-shaped segment has an inner radius of curvature substantially equivalent to an outer radius of the inner member and a radial thickness of the dielectric insulation.

5. The support assembly of claim 2 wherein the dielectric insulation includes a first layer and a second layer of insulating material having a length substantially equivalent to the circumferential length of the inner member, said first layer being wrapped around the inner member and said second layer being wrapped around the first layer to prevent flux leakage from the inner member.

6. The support assembly of claim 2 further including:

one or more outer clamp members secured around the circumference of the outer member at spaced-apart intervals;

outer dielectric insulation disposed between the outer member and each clamp member to electrically isolate the clamp members from the outer member; and a support structure secured to each outer clamp to provide support for the inner and outer members.

7. The support assembly of claim 6 wherein each outer clamp member includes two segments having a substantially semicircular arc shape that fit snugly around the outer dielectric insulation upon assembly of the outer clamp member, and two flanges extending radially outwardly from each segment with one flange being disposed at each end of the segments, the flanges of one segment being secured to the flanges of the other segment upon assembly of the outer clamp member.

8. In an impedance heating system for heating material contained inside a storage tank having a hollow tubular outer conductor supported inside the tank and a cylindrical inner conductor disposed inside the outer conductor, the improvement comprising:

a plurality of dielectric insulation layers having high compression characteristics, whereby two layers of insulation are wrapped around the inner conductor at predetermined spaced-apart intervals; and a plurality of spacers with each spacer having a cylindrical body secured around the dielectric insulation and a plurality of flanges extending radially outwardly from the body for coaxially positioning the inner conductor within the outer conductor, the dielectric insulation electrically isolating the spacers from the inner conductor, said flanges being adapted to allow for slidable movement of the inner conductor and spacers with respect to the outer conductor.

9. The impedance heating system of claim 8 wherein the body of each spacer includes two 180° arc-shaped segments adapted to fit snugly around the dielectric insulation with a first flange extending radially outwardly from a first end of each segment and a second flange extending radially outwardly from a second end of each segment, the first and second flanges associated with one segment being secured to the first and second flanges of the other segment upon assembly of the spacer.

10. The impedance heating system of claim 9 wherein each segment of the body includes three flanges equally space apart extending radially outwardly from the segment.

11. In an impedance heating system for heating material contained inside a pipeline storage and distribution system including an inner pipe for containing the material and an outer tubular member for housing the inner pipe therein, the improvement comprising:

inner dielectric insulation wrapped around the inner pipe at predetermined spaced-apart intervals;

one or more spacers adapted to fit securely around the inner dielectric insulation at each location along the inner pipe, each spacer having a plurality of flanges extending radially outwardly therefrom for coaxially supporting the inner pipe within the outer member, said flanges allowing for slidable movement of the inner and spacer with respect to the outer member;

outer dielectric insulation wrapped around the outer member at predetermined spaced-apart intervals;

a plurality of clamps with each clamp having a substantially tubular body portion positioned around the outer dielectric insulation along the outer member; and a support structure secured to each outer clamp to provide support for the pipeline system.

12. The impedance heating system of claim 11 wherein the body portion of each outer clamp member includes two segments having a substantially semicircular arc shape adapted to fit snugly around the outer dielectric insulation layers.

13. The impedance heating system of claim 12 wherein each segment of the outer clamps includes at least two flanges extending radially outwardly therefrom with one flange being disposed at each end of the segments, the flanges of one segment being secured to the flanges of the other segment upon assembly of the outer clamp member.

* * * * *